US005950379A

United States Patent [19]

Moore et al.

[11] Patent Number: 5,950,379

[45] Date of Patent: Sep. 14, 1999

[54] WINDOW FRAME WITH ANGLED GLAZING LEGS

[75] Inventors: Earl S. Moore, Orlando; Lovell B. Reed, Deltona, both of Fla.

[73] Assignee: Florida Extruders International, Inc., Sanford, Fla.

[21] Appl. No.: 08/370,170

[22] Filed: Jan. 9, 1995

[51] Int. Cl.[6] ..... E06B 7/16

[52] U.S. Cl. ..... 52/204.5; 52/204.57; 52/204.591; 52/204.7; 52/656.5

[58] Field of Search ..... 52/204.1, 204.5, 52/204.591, 204.7, 204.597, 204.57, 656.5

[56] References Cited

U.S. PATENT DOCUMENTS

| | | | |
|---|---|---|---|
| 2,304,423 | 12/1942 | Schiller . | |
| 2,736,403 | 2/1956 | Gwynne . | |
| 2,830,684 | 4/1958 | Bancroft | 52/204.591 X |
| 2,852,113 | 9/1958 | Bancroft . | |
| 2,916,112 | 12/1959 | Kiehl . | |
| 3,099,337 | 7/1963 | Hetman | 52/204.597 |
| 3,140,763 | 7/1964 | Edelstein | 50/204.591 X |
| 3,191,727 | 6/1965 | Schmeltz et al. | 52/204.593 |
| 3,934,384 | 1/1976 | Davis | 52/204.591 |
| 4,376,359 | 3/1983 | Redman | 52/204.591 X |
| 4,621,472 | 11/1986 | Kloke | 52/204.591 |
| 4,799,344 | 1/1989 | Francis | 52/204.591 X |
| 4,860,517 | 8/1989 | Kipross | 52/204.591 X |
| 4,949,506 | 8/1990 | Durham . | |
| 4,999,958 | 3/1991 | Harrison . | |
| 5,155,956 | 10/1992 | Norment et al. . | |

FOREIGN PATENT DOCUMENTS

| | | | |
|---|---|---|---|
| 2272244 | 5/1994 | United Kingdom | 52/204.5 |

*Primary Examiner*—Carl D. Friedman
*Assistant Examiner*—Winnie S. Yip
*Attorney, Agent, or Firm*—Renner, Otto, Boisselle & Sklar, P.L.L.

[57] ABSTRACT

A window frame includes a plurality of horizontal and vertical frame members each having glazing legs with angled exteriorly facing sides that overlap at the corners and substantially flat planar inwardly facing glazing surfaces against which a glazing element is set in place, with bedding compound between the glazing element and glazing surfaces to adhere the glazing element to the glazing legs. Pockets extending substantially the entire length of the glazing surfaces provide for the positive, accurate location of a continuous bead of bedding compound on the glazing surfaces and control the amount of the glazing compound that is squeezed out between the glazing element and glazing surfaces when the glazing element is set in place to insure a watertight seal around the entire perimeter of the glazing element.

33 Claims, 2 Drawing Sheets

WINDOW FRAME WITH ANGLED GLAZING LEGS

FIELD OF THE INVENTION

This invention relates to a window frame having angled glazing legs that virtually eliminate any possible water seepage between the exterior of the window glass and window frame.

BACKGROUND OF THE INVENTION

Glazed window frames made from horizontal and vertical frame members usually have generally L-shape glazing legs that butt up against each other at the corners where the frame members are joined together. Accordingly, if the bead of glazing compound that is applied to the glazing legs is not squeezed out sufficiently when the glass or other glazing element is seated against the glazing legs, a gap will occur at the butt joints through which water could seep in.

It is generally known to provide internal glazed window frames with angled glazing legs. However, heretofore such angled glazing legs did not assure against water seepage between the glass exterior and glazing legs.

SUMMARY OF THE INVENTION

The present invention is for an improved window frame that has the appearance of an externally glazed window or sliding glass door but is internally glazed in such a way as to eliminate any possible water seepage between the glass or other glazing element exterior and window frame.

In accordance with one aspect of the invention, the window frame includes angled glazing legs on both the horizontal and vertical frame members that overlap at the corners to eliminate any possible gaps in the bedding compound that is applied to the glazing legs for adhering the glazing element to the glazing legs, and to give the glazing legs some depth so the glazing legs do not have a flat appearance from the exterior.

In accordance with another aspect of the invention, the ends of the horizontal frame members and associated glazing legs are cut square whereas the ends of the vertical glazing legs are notched back to the planar surface of the vertical frame members at substantially the same angle as the exterior angled surface of the horizontal glazing legs whereby when the ends of the horizontal frame members are butted up against the planar surfaces of the vertical frame members, the notched ends of the vertical glazing legs will overlap in close mating engagement with the ends of the horizontal glazing legs to improve sealing capabilities.

In accordance with another aspect of the invention, the glazing legs include substantially flat planar glazing surfaces against which the glazing element is set, and pockets in the glazing surfaces that provide a positive, accurate location for the application of bedding (glazing) compound to the glazing legs and accurate control of the amount of glazing compound that is squeezed out between the glazing element and glazing legs when the glazing element is set in place to assure a watertight seal around the entire perimeter of the glazing element.

In accordance with another aspect of the invention, the flat planar glazing surfaces of the glazing legs have serrations therein to provide for increased thickness of the bedding compound between the glazing element and glazing legs for increased life and better adherence of the glazing element to the glazing legs.

In accordance with another aspect of the invention, one or both sides of the pockets in the glazing surfaces of the glazing legs are reversely wedge shaped to increase the size of the pockets for increasing the amount of bedding compound in the pockets for increased adherence between the glazing element and glazing legs at the pockets while still leaving enough glazing surface area adjacent opposite sides of the pockets for the glazing element to set on and to give the glazing legs sufficient strength so as not to crack when the glazing element is set in place.

In accordance with another aspect of the invention, the radial innermost sides of the pockets are deeper than the radial outermost sides which increases the size of the pockets and thus increases the amount of glazing compound that can be pushed into the pockets to provide better adhesion of the glazing element to the glazing legs at the pockets.

In accordance with another aspect of the invention, after the glazing leg pockets have been filled with glazing compound and the glazing element has been set in place, a vinyl bead may be inserted around the interior perimeter of the glazing element to provide a setting block for the glazing element and keep the glazing element from shifting and to cover the glazed beading area of the window frame.

In accordance with another aspect of the invention, cavities formed at the ends of the vertical glazing legs where the vertical glazing leas meet the angled exterior surfaces of the horizontal glazing legs are filled with joint compound to prevent water from entering such cavities.

In accordance with another aspect of the invention, the vertical and horizontal frame members of the window frame are joined together by horizontal screws extending through holes in the ends of the vertical frame members into threaded engagement with spaced apart horizontal screw bosses on the horizontal frame members to draw the frame members together thereby assuring a close overlapping fit between the ends of the glazing legs.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
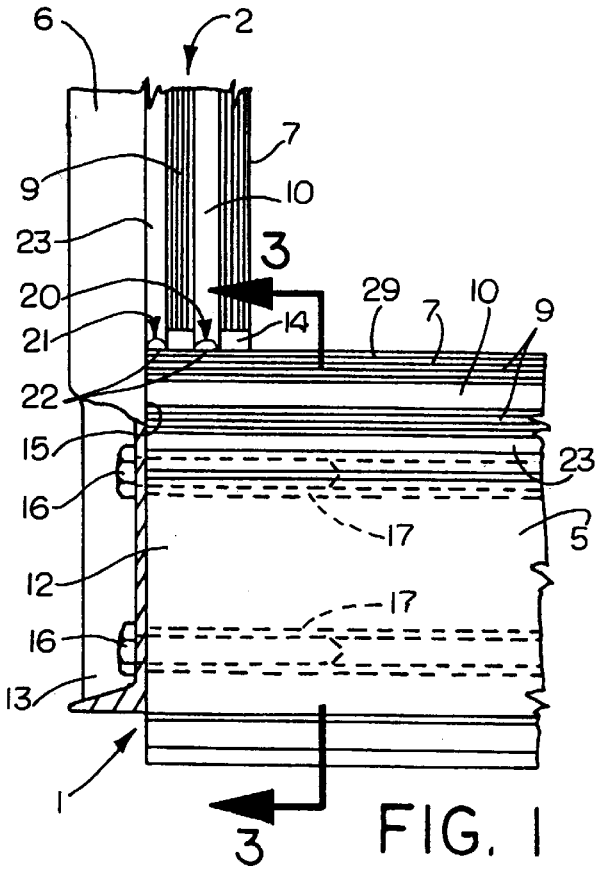
FIG. 1 is a fragmentary interior plan view of one of the corners (i.e., the lower left-hand corner) of a preferred form of window frame in accordance with the present invention prior to installation of the glazing element to better show how the glazing legs overlap at the corners.
Figure 3:
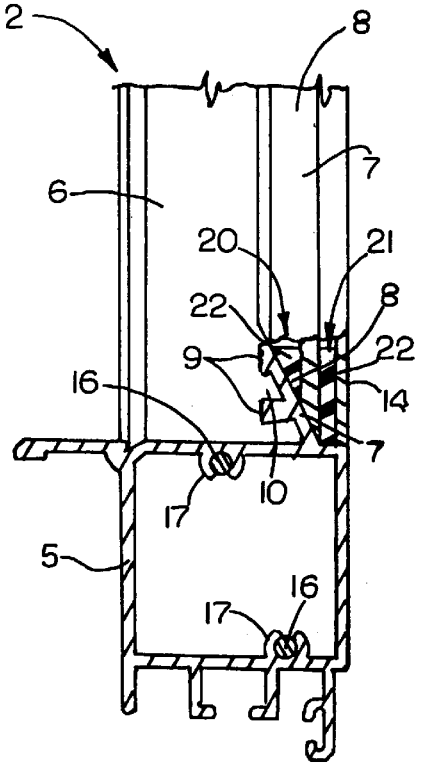
FIG. 3 is a fragmentary vertical section through the horizontal rail or frame member of FIG. 1 taken generally along the plane of the line 3—3 thereof to show how the angled glazing legs overlap at the corners, and with the lower overlapping end of the vertical glazing leg partially broken away to show the two cavities formed where the end of the vertical glazing legs meet the exterior angled surface of She horizontal glazing legs which are filled with joint compound.
Figure 2:
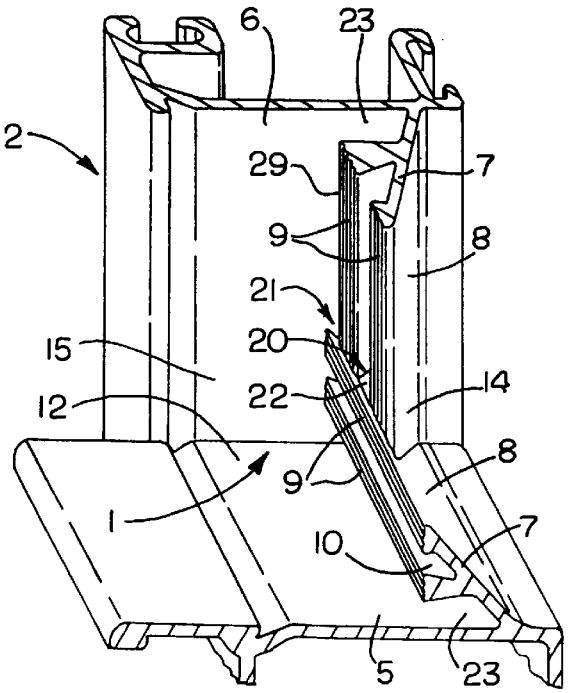
FIG. 2 is a fragmentary isometric view of the portion of the window frame shown in FIG. 1.

Referring now in detail to the drawings, and initially to FIGS. 1 through 3, one of the corners 1 (in this case the lower left-hand corner) of a preferred form of window frame 2 in accordance with this invention is illustrated prior to being glazed. The window frame 2 may for example be incorporated in a single or double hung window assembly, a horizontal sliding window or door assembly, or a fixed window assembly as desired. Also, the window frame 2 may be a single glazed or insulated (double glazed) window frame assembly as desired.

The window frame 2 shown includes two horizontal frame or rail members and two vertical frame members or sash jambs preferably made of extruded aluminum and joined at the corners as described hereafter. In the various figures only one of the horizontal and vertical frame members 5, 6 are shown joined together at one of the corners (i.e., lower left-hand corner 1), since it is intended that the frame members be similarly joined together at all of the corners and thus the other frame members are omitted for clarity.

Extending along the length of each frame member 5, 6 adjacent the exterior or outer side thereof is a glazing leg 7 having an exteriorly facing surface 8 that slopes inwardly at an acute angle, for example approximately 65°, from the general plane of the frame members. This permits the ends of the glazing legs to be overlapped at the corners as described hereafter to eliminate any possible gaps in the bedding (glazing) compound that is applied to the glazing legs before the glazing element is set in place, thereby eliminating any possible water leaks at the corners. Also, the external slope of the glazing legs gives the window frame the appearance of an externally glazed window even though internally glazed.

The glazing legs 7 are generally triangular in cross section and include substantially flat planar glazing surfaces 9 that extend substantially perpendicular to the general plane of the frame members 5, 6 and face toward the interior of the window frame 2 For setting of the glazing element against such planar glazing surfaces. Intermediate the width of the glazing surfaces 9 is an interiorly opening pocket or groove 10 which extends substantially the entire length of the glazing surfaces for laying of a continuous bead of the bedding compound along the length thereof as described hereafter.

Figure 5:
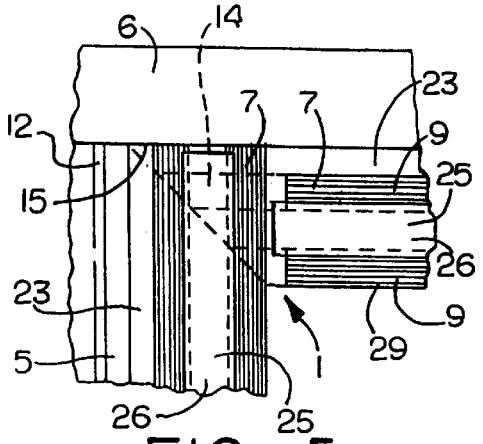
FIG. 5 is a fragmentary top plan view of the glazing legs and associated frame members at one of the corners of the window frame of FIG. 4 as generally seen from the plane of the line 5—5 thereof.

Before the ends of the horizontal and vertical frame members 5, 6 are joined together, the ends 12 of the horizontal frame members 5 and associated glazing legs 7 are cut square. Likewise, the ends 13 of the vertical frame members 6 are cut square. However, the ends 14 of the glazing legs 7 on the vertical frame members 6 are notched back to the planar surface 15 of the vertical frame members at an angle corresponding to the angled exteriorly facing surface 8 of the glazing legs (in this case 65°). This is done so that when the ends of the horizontal frame members 5 are butted up against the planar surfaces 15 of the vertical frame members 6, the ends of the glazing legs will overlap in close mating engagement with each other as best seen in FIGS. 2, 3 and 5.

Preferably, the horizontal and vertical frame members 5, 6 are attached together at the ends by two screws 16 at each end extending through holes in the planar surfaces 15 of the vertical frame members 6 into threaded engagement with two spaced apart screw bosses 17 on the horizontal frame members 5 as schematically shown in FIGS. 1 and 3. The horizontal screws 16, which when tightened draw the frame members 5, 6 together, insure a close overlapping fit of the notched ends 14 of the glazing legs 7 on the vertical frame members 6 with the exterior sloping surfaces 8 of the glazing legs on the horizontal frame members 5 to improve sealing capabilities and keep the frame members from rotating at the corners. Also, the double screw 16 and screw boss 17 construction help to keep the frame members 5, 6 from rotating during extreme weather conditions and improve the strength of the window frame 2.

After the frame members 5, 6 are fastened together, the two cavities 20, 21 at the ends of the vertical glazing legs where the vertical glazing legs meet the exterior sloping surfaces 8 of the horizontal glazing legs are desirably filled with joint compound 22 as schematically illustrated in FIGS. 1 and 3 to provide a watertight seal between the overlapping ends of the glazing legs. One of the cavities 20 is formed by an extension of the pocket 10 in the vertical glazing legs where notched back at a 65° angle at the ends 14, whereas the other cavity 21 is formed by an extension of the gap 23 between the general plane of the vertical frame members 6 and adjacent glazing surfaces 9 of the vertical glazing legs where notched back.

Figure 4:
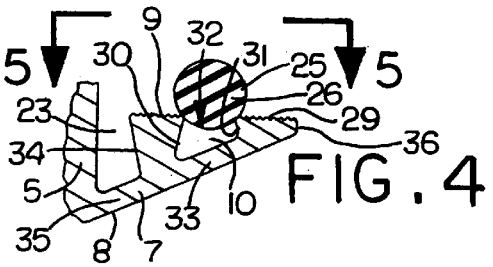
FIG. 4 is an enlarged transverse section through one of the glazing legs of the window frame of the present invention showing the window frame oriented with the exterior surface of the glazing legs facing generally downwardly and the planar glazing surfaces of the glazing legs facing generally upwardly to facilitate laying of a round bead of bedding compound into an upwardly opening pocket in the glazing legs.
Figure 6:
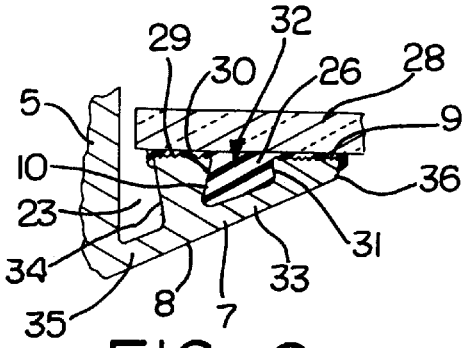
FIG. 6 is an enlarged transverse section through one of the glazing legs similar to FIG. 4 but showing the glazing element pressed against the bedding compound which causes the bedding compound to fill the glazing leg pocket and squeeze out between the glazing element and is the flat planar glazing surfaces of the glazing leg adjacent opposite sides of the pocket.

The preferred shapes of the pockets 10 in the glazing surfaces 9 and gaps 23 between the glazing surfaces 9 and adjacent planar surfaces of the frame members 5, 6 substantially throughout their length are best shown in FIGS. 4 and 6. In these two figures (as well as in FIGS. 5, 7 and 8) the window frame 2 is shown oriented with the exterior surface 8 of the glazing legs 7 facing generally downwardly and the planar glazing surfaces 9 of the glazing legs 7 facing generally upwardly. Such orientation facilitates the laying of a continuous round bead 25 of bedding (glazing) compound 26 into the upwardly facing glazing leg pockets 10 throughout substantially their entire length (preferably to within approximately 1/64 inch of the ends of the glazing legs) prior to setting the glass or other glazing element 28 against the glazing legs as schematically shown in FIG. 6.

Figure 7:
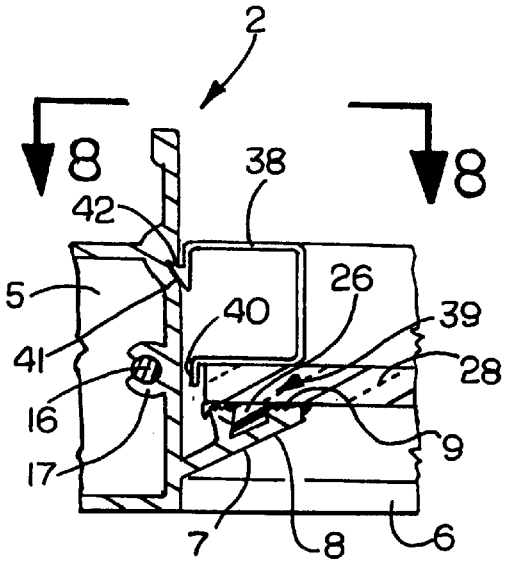
FIG. 7 is a fragmentary transverse section through a portion of the window frame of the present invention showing the glazing element set- in place against the glazing leg and a vinyl bead snapped into place on the inside of the glazing element to protect the edge of the glazing element and cover the beading area.

The advantage in having pockets 10 in the glazing legs 7 is that the pockets provide a positive accurate location for the application of the bead of bedding compound 26 to the glazing legs. Also, when the glazing element 28 is subsequently set in place, pushing the bedding compound 26 into the pockets 10 to completely fill the pockets with the bedding compound, a controlled amount of the bedding compound is squeezed out in both directions between the glass and the flat planar glazing surfaces 9 of the glazing legs adjacent opposite sides of the pockets as schematically shown in FIGS. 6 and 7. Not only do the pockets provide a greater amount of bedding compound on the glazing legs for better adhesion of the glazing element to the glazing legs, but also provide for better control of the amount of bedding compound that is squeezed out in both directions between the glazing element 28 and glazing surfaces 9 of the glazing legs adjacent opposite sides of the pockets.

If the amount of squeeze-out is too thin, the bedding compound will not effectively adhere both to the glazing element and glazing leg surfaces. Accordingly, the diameter of the bead 25 of bedding compound 26 should be such that when the glazing element is pressed into the bedding compound, the bedding compound will not only substantially completely fill the pockets, but will also squeeze out in both directions over substantially the entire width of the glazing surfaces 9. Also, serrations 29 are desirably provided on the glazing surfaces 9 adjacent both sides of the pockets 10 to increase the thickness or depth of the bedding compound which is squeezed out between the glazing element and glazing surfaces for increased life and better adherence of the bedding compound to both surfaces.

To maximize the size of the pockets 10 so that they hold more bedding material for increased adhesion between the glazing element and glazing legs in the region of the pockets and still provide enough flat glazing surface area 9 adjacent opposite sides of the pockets for the glazing element to set on and give the glazing legs 7 sufficient strength so they don't crack when the glazing element is set in place, the pockets desirably have reversely wedge shaped sides 30, 31 that slope away from each other as best seen in FIGS. 4 and 6. This results in the smallest width dimension of the pockets being at the pocket opening 32 and the largest width dimension being adjacent the bottom wall 33. Also, the thickness of the bottom wall 33 of the pockets 10 is desirably substantially uniform throughout their width and length, whereby the side 30 of the pockets closest to the planar surface of the respective frame members is deeper than the other side 31 because of the triangular cross section of the glazing legs to increase the size of the pockets while still providing a minimum bottom wall thickness to insure against cracking of the glazing legs when the glazing element is set in place.

The outermost wall 34 of the gap 23 between the is planar glazing surfaces 9 of the glazing legs and adjacent planar surface of the frame members desirably extends at an angle away from such planar surface as best seen in FIGS. 4 and 6 to maximize the innermost planar glazing surface areas and still provide enough of a gap along the bottom wall 35 for ease of notching of the ends 14 of the vertical glazing legs at the desired angle.

Although the dimensions of the glazing legs may vary within certain limits, it is preferred that the overall width of the glazing legs 7 from the flat planar surface of the frame members to the outermost edge 36 of the glazing legs be approximately ½ inch, and that each of the flat planar glazing surfaces 9 adjacent opposite sides of the pockets 10 as well as the pocket opening 32 have a width of approximately ⅛ inch. These dimensions have been found to be sufficient to support the glazing element and to cause the glazing element to adhere to the glazing legs when the bedding compound 26 substantially completely fills the pockets 10 and is squeezed out between the glazing element and planar glazing surfaces over substantially their entire width. Moreover, because the depth or thickness of the bedding compound in the pockets 10 is greater than the thickness of the bedding compound between the glazing element and glazing surfaces 9 of the glazing legs 7, the adhesion of the bedding compound to the glass is greater at the pocket opening 32 than at the glazing surfaces. The bedding compound 26 that is squeezed out between the glazing element 28 and outermost planar glazing surface 9 also forms a waterproof seal between the glazing element and glazing legs around the entire periphery.

In this particular embodiment, the width of the gaps 23 in the plane of the glazing surfaces 9 is also approximately ⅛ inch. If desired, the gaps 23 could be eliminated, which would increase the overall width of the glazing surfaces 9 by approximately another ⅛ inch. However, it has been found that providing a gap 23 between the innermost glazing surface 9 and adjacent planar surface of the vertical frame members 6 makes it easier to shear the ends of the vertical glazing legs at the desired angle for obtaining the desired overlap of the vertical and horizontal glazing legs at the corners.

Also in this particular embodiment, the exteriorly facing surface 8 of the glazing legs 7 extends at an angle of approximately 65° from the general plane of the frame members 5, 6. However, it should be understood that this angle could be somewhat more or less than 65° as desired. Of course, the angle of the exteriorly facing surfaces of the glazing legs must be the same on all of the frame members 5, 6 in order for the glazing legs to properly match up and overlap each other at the corners in the manner previously described. Also, it is important that the glazing legs be sufficiently angled to give them some depth, so that the window assemblies have the appearance of externally glazed window frames even though they are internally glazed.

Figure 8:
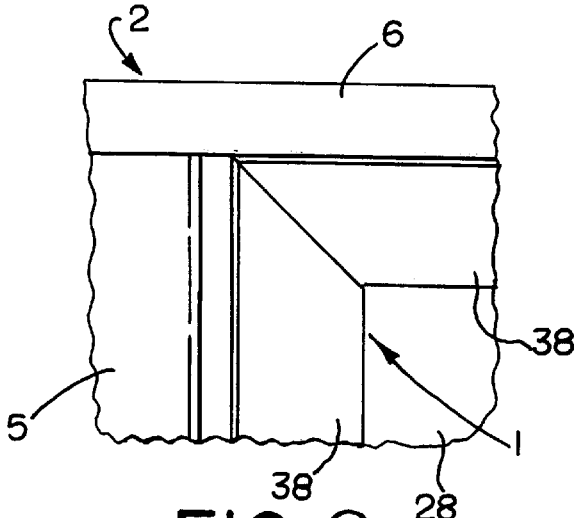
FIG. 8 is a fragmentary top plan view of the window frame of FIG. 7 at one of the corners as generally seen from the plane of the line 8—8 thereof.

After the glazing element 28 has been set in place, a vinyl glazing head 38 is desirably inserted around the inner periphery of the glazing element and snapped in place to protect the edge of the glazing element and cover the beading area 39 as schematically shown in FIGS. 7 and 8. The glazing bead 38 has an outturned flange 40 that extends between the peripheral edge of the glazing element 28 and adjacent planar surface of the frame members 5, 6 to provide a setting block for the glazing element and to help keep the glazing element from shifting (see FIG. 7). An inwardly facing hook 41 extending along an interior edge of the glazing bead 38 snaps into a hook shaped slot 42 on the planar surface of the frame members 5, 6 to retain the glazing bead in place. The particular vinyl glazing bead 38 shown is a box bead which is generally square or rectangular in cross section to facilitate mounting of muntin bars to the window frame. However, it will be apparent that the vinyl glazing bead may take other shapes as well.

From the foregoing, it will now be apparent that the angled glazing legs on the frame members of the window frame of the present invention overlap at the corners where the frame members are joined together to eliminate any possible water seepage between the exterior of the glazing element and window frame. Also, even though the window frame is interiorly glazed, the external slope of the glazing legs gives the window frame the appearance of an externally glazed window frame.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A window frame comprising a plurality of horizontal and vertical frame members joined together at a plurality of corners, said frame members including glazing legs extending substantially the entire length of said frame members, said glazing legs having exteriorly facing surfaces that slope inwardly at an acute angle relative to a generally planar surface of said frame members and substantially flat planar glazing surfaces that extend substantially perpendicular to said planar surface of said frame members, said horizontal frame members and associated horizontal glazing legs having ends that are cut square, and said vertical frame members having ends that are cut square and associated vertical glazing legs that are notched back to said planar surfaces of said vertical frame members at substantially the same angle as said exteriorly facing surfaces of said horizontal glazing legs, said square ends of said horizontal frame members being butted up against said planar surfaces of said vertical frame members, and the notched ends of said vertical glazing legs overlapping the ends of said horizontal glazing legs in close mating engagement with said exteriorly facing surfaces of said horizontal glazing legs.

2. The frame of claim 1 wherein said horizontal and vertical frame members are attached together by screws extending through holes in said vertical frame members into threaded engagement with screw bosses on said horizontal frame members.

3. The frame of claim 2 wherein each of said horizontal frame members includes a pair of spaced apart screw bosses for receiving a pair of screws at each end of said vertical frame members which when tightened draw the notched ends of said vertical glazing legs into close overlapping engagement with said outwardly facing sides of said horizontal glazing legs.

4. The frame of claim 1, further comprising a glazing element set in place against said glazing surfaces, and bedding compound between said glazing element and said glazing surfaces to adhere said glazing element to said glazing legs.

5. The frame of claim 4 wherein said glazing surfaces include serrations to increase the depth of said bedding compound and thus the adhesion of said bedding compound to said glazing element and said glazing legs.

6. The frame of claim 4 further comprising a vinyl glazing bead extending around an inner periphery of said glazing element for covering said glazing surfaces of said glazing legs.

7. The frame of claim 6 wherein said glazing bead has an outturned flange which extends between a peripheral edge of said glazing element and said planar surface of said frame members to provide a setting block for said glazing element and help keep said glazing element from shifting, and an inwardly facing hook that snaps into a hook shaped slot on said planar surfaces of said frame members.

8. A window frame comprising a plurality of frame members joined together at a plurality of corners, each of said frame members including a glazing leg extending substantially the entire length of said frame members, each of said glazing legs having an exteriorly facing surface that slopes inwardly at an acute angle relative to a generally planar surface of said frame members and a pair of substantially flat, planar glazing surfaces that extend substantially perpendicular to said planar surface of each of said frame members, said glazing surfaces being separated by a pocket extending substantially the entire length of said glazing surfaces for locating a continuous bead of bedding compound intermediate said glazing surfaces, said pocket having an opening in the plane of said glazing surfaces and defined by spaced apart inner and outer side walls and a bottom wall extending between said side walls in spaced relation to said opening, said side walls being reverse wedge shaped such that said side walls slope away from each other with increased depth from said opening to said bottom wall to increase the size of each said pocket and thus the amount of bedding compound held thereby without increasing the size of the opening to each said pocket.

9. The frame of claim 8 wherein said bottom wall of each said pocket extends at an angle relative to said glazing surfaces, such that the depth of each said pocket progressively increases from said outer side wall to said inner side wall.

10. The frame of claim 9 wherein said bottom wall has a substantially uniform thickness throughout the width of each said pocket.

11. The frame of claim 8 further comprising a gap between said planar surface of each of said frame members and the innermost glazing surface of each said glazing leg.

12. The frame of claim 11 wherein said gap has a reverse wedge shape outer wall whereby the width of said gap increases with increased depth.

13. The frame of claim 11 wherein each of said glazing surfaces has approximately the same width.

14. The frame of claim 13 wherein the opening to each said pocket has approximately the same width as said glazing surfaces.

15. The frame of claim 14 wherein said gap has an opening in the plane of said glazing surfaces of approximately the same width as the opening to each said pocket.

16. The frame of claim 15 wherein the width of the openings to each said pocket and said gap and the width of said glazing surfaces are each approximately ⅛ inch.

17. The frame of claim 8 further comprising a glazing element set in place against said glazing surfaces, and bedding compound substantially completely filling each said pocket and adhering to said glazing element.

18. The frame of claim 17 wherein said planar glazing surfaces include innermost and outermost glazing surfaces on each said glazing leg and said bedding compound is squeezed outwardly from each said pocket between said glazing element and said outermost glazing surface of each said glazing leg to adhere said glazing element to said outermost glazing surface and form a fluid-tight seal therebetween.

19. The frame of claim 18 wherein said bedding compound is also squeezed inwardly from each said pocket between said glazing element and said innermost glazing surface to adhere said glazing element to said innermost glazing surface.

20. The frame of claim 19 wherein each said pocket progressively increases in depth from said outer side wall toward said inner side wall for increasing the depth of said bedding material and thus the adhesion of said bedding material with said glazing element from said outer side wall of each said pocket toward said inner side wall.

21. The frame of claim 20 wherein said side walls slope away from each other from the opening to each said pocket toward said bottom wall to increase the size of each said pocket and thus the amount of bedding compound contained in each said pocket for increased adhesion between said glazing element and said bedding compound in each said pocket.

22. The frame of claim 19 wherein said glazing surfaces include serrations to increase the depth of said bedding compound and thus the adherence of said bedding compound to said glazing element at said glazing surfaces.

23. The frame of claim 17 further comprising a vinyl glazing bead extend around an inner periphery of said glazing element for covering each said glazing leg as viewed from an interior side of said frame.

24. The frame of claim 23 wherein said glazing bead has an outturned flange extending between a peripheral edge of said glazing element and said planar surface of said frame members to provide a setting block for said glazing element and help keep said glazing element from shifting, and an inwardly facing hook that snaps into a hook shaped slot on said planar surface of said frame members.

25. The frame of claim 8 wherein the glazing legs of the respective frame members overlap at said corners to eliminate any gaps in the bedding compound which is applied to said glazing legs before a glazing element is set in place against said glazing surfaces.

26. A window frame comprising a plurality of frame members joined together at a plurality of corners, each of said frame members including a glazing leg extending substantially the entire length of said frame members, each of said glazing legs having an exteriorly facing surface that slopes inwardly at an acute angle relative to a generally planar surface of said frame members and a pair of substantially flat, planar glazing surfaces that extend substantially perpendicular to said planar surface of each of said frame members, said glazing surfaces being separated by a pocket extending substantially the entire length of said glazing surfaces for locating a continuous bead of bedding compound intermediate said glazing surfaces, said pocket having an opening in the plane of said glazing surfaces and defined by spaced apart inner and outer side walls and a bottom wall extending between said side walls in spaced relation to said opening, the glazing legs of the respective frame members overlapping at said corners to eliminate any gaps in the bedding compound which is applied to said glazing legs before a glazing element is set in place against said glazing surfaces, said frame members including horizontal frame members and respective horizontal glazing legs having ends that are cut square in line with each other and vertical frame members that are cut square and respective vertical glazing legs that are notched back to said planar surface of said vertical frame members at substantially the same angle as said exteriorly facing surfaces of said horizontal glazing legs, said square ends of said horizontal frame members being butted up against said planar surfaces of said vertical frame members, and the notched ends of said vertical glazing legs overlapping the ends of said horizontal glazing legs in close mating engagement with said exteriorly facing surfaces of said horizontal glazing legs.

27. The frame of claim 26 further comprising a continuous bead of bedding compound extending substantially the full length of each said pocket.

28. The frame of claim 27 further comprising a glazing element set in place against said glazing surfaces, said bedding compound substantially completely filling each said pocket and extending between said glazing element and said glazing surfaces to adhere said glazing element to said glazing legs.

29. The frame of claim 28 wherein each said pocket progressively increases in depth from said outer side wall toward said inner side wall to provide for increased depth of said bedding material in each said pocket to increase the adhesion between said glazing element and said bedding material from said outer side wall toward said inner side wall.

30. The frame of claim 26 wherein each said pocket at the ends of said vertical glazing legs forms cavities with said exteriorly facing surfaces of said horizontal glazing legs that are filled with joint compound.

31. The frame of claim 30 wherein said planar glazing surfaces include innermost and outermost glazing surfaces on each said glazing leg, further comprising gaps between said planar surfaces and said innermost glazing surfaces of said frame members, said gaps at the ends of said vertical frame members forming other cavities with said exteriorly facing surfaces of said horizontal glazing legs that are filled with joint compound.

32. The frame of claim 26 wherein said horizontal and vertical frame members are attached together by screws extending through holes in the ends of said vertical frame members into threaded engagement with screw bosses on said horizontal frame members.

33. The frame of claim 32 wherein each of said horizontal frame members includes a pair of spaced apart screw bosses for receiving a pair of screws extending through each end of said vertical frame members which when tightened draw the notched ends of said vertical glazing legs into close overlapping engagement with the ends of said horizontal glazing legs.

* * * * *